United States Patent [19]

Bogner

[11] 4,086,598

[45] Apr. 25, 1978

[54] BROADBAND OMNIDIRECTIONAL SLOT ANTENNA WITH AN ELECTRICAL STRAP CONNECTOR

[76] Inventor: Richard D. Bogner, 4 Hunters La., Roslyn, N.Y. 11576

[21] Appl. No.: 746,857

[22] Filed: Dec. 2, 1976

[51] Int. Cl.[2] ..... H01Q 3/26

[52] U.S. Cl. ..... 343/768; 343/789

[58] Field of Search ..... 343/767, 768, 771, 789, 343/770

[56] References Cited

U.S. PATENT DOCUMENTS

| | | | |
|---|---|---|---|
| 2,684,444 | 7/1954 | Fales | 343/789 |
| 3,587,108 | 6/1971 | Bogner | 343/770 |
| 3,665,480 | 5/1972 | Fassett | 343/768 |
| 4,021,815 | 5/1977 | Bogner | 343/836 |

*Primary Examiner*—Alfred E. Smith
*Assistant Examiner*—David K. Moore

[57] ABSTRACT

A broadband omnidirectional slot antenna suitable for transmission of television signals employing a wide slot and a wide, long strap between a feed point and the slot edge.

7 Claims, 7 Drawing Figures

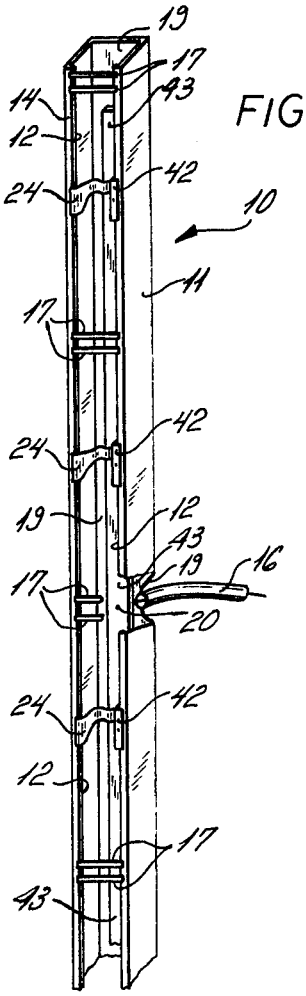
FIG. 7
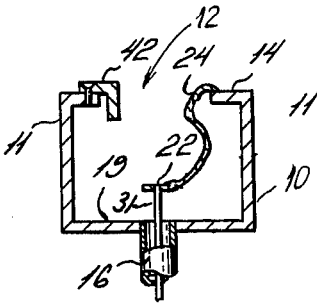
FIG. 2
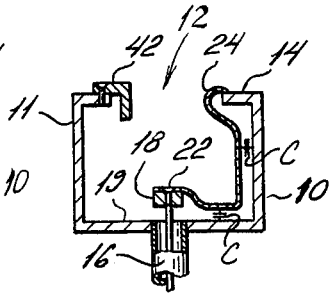
FIG. 3
(PRIOR ART)
FIG. 1
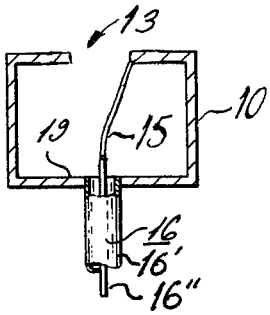
FIG. 4
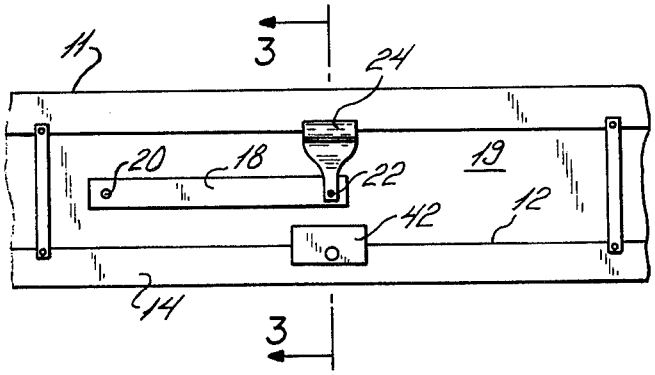
FIG. 5
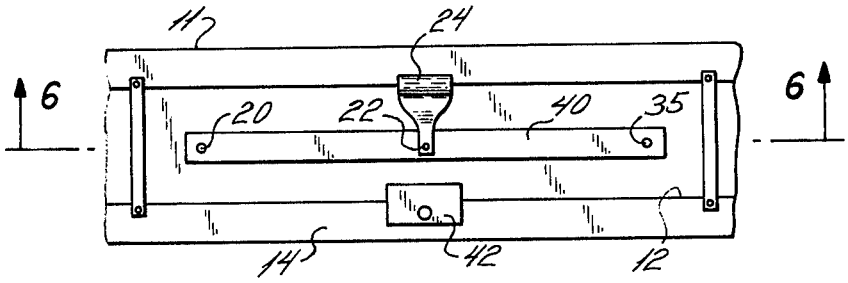
FIG. 6
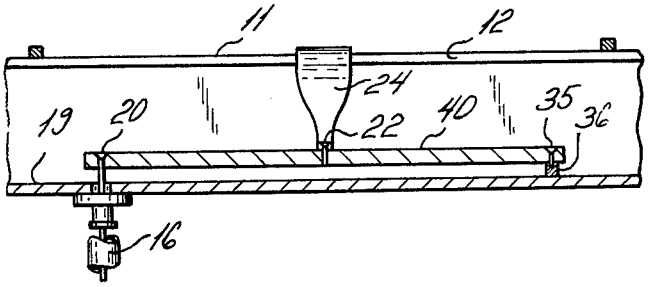

BROADBAND OMNIDIRECTIONAL SLOT ANTENNA WITH AN ELECTRICAL STRAP CONNECTOR

BACKGROUND OF THE INVENTION

Slot antennas and arrays thereof are widely used for transmission of electromagnetic signals. An example of such antennas is disclosed in applicant's U.S. Pat. No. 3,587,108, issued June 22, 1971.

Antennas employed for the transmission of television signals are required to transmit signals covering at least six megaHertz, and often a several times greater bandwidth if, e.g., the antenna is used for several channels.

In the design of slot antennas it is often desirable to have large impedance bandwidth (i.e. low Q), and also to have omnidirectional radiation patterns in the plane transverse to the slot (E plane). To a first order the impedance bandwidth of a slot is a direct function of slot volume. However, the departure of E plane pattern from omnidirectional, and the difficulty of arraying efficiently, are both inverse functions of slot volume; i.e. the slot should be short and small in cross section (girth) to meet these latter requirements. Therefore, slot design often requires considerable compromise if e.g. E plane pattern variation of less than $\pm$ 3 db (considered omnidirectional in the industry), VSWR under 1.1 over 20% or more bands, and linear arraying of many slots are required simultaneously. Mechanically, it is also desirable to combine an array of slot antennas into a long linear array of slots using a single continuous cavity.

It has been found that by use of a particular size slot exciting strap, located in the cavity and fed in a manner described more fully hereinafter, it is possible to obtain low Q, a small cavity length and cross section while achieving the pattern, VSWR, and arraying properties required.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

IN THE DRAWINGS

FIG. 1 is a transverse cross-sectional view of a typical prior art slot antenna;

FIG. 2 is a sectional view similar to FIG. 1 of a typical slot of this invention;

FIG. 3 is a sectional view taken along lines 3—3 of FIG. 4;

FIG. 4 is a top view of a typical slot of this invention showing a strip line type feed structure;

FIG. 5 is a front view of another alternative feed system;

FIG. 6 is a sectional view taken along lines 6—6 of FIG. 5; and

FIG. 7 is a pictorial view of an array of slot antennas.

DESCRIPTION OF THE PREFERRED EMBODIMENT

Slot type antennas have long been employed for broadcast purposes. A typical prior art bay of this type antenna is shown in cross-section in FIG. 1. The antenna consists of an elongated electrically conductive tubular housing 10 defining a cavity 11. The face of the housing is partially open, the narrow opening being known in the field as a "slot" 13. The slot 13 may be fed from a transmitter (not shown) by a two-conductor line such as coaxial line 16. The outer conductor 16' may be connected to the housing at the inner face 19 and the coaxial line inner conductor 16" to the edge of the slot 13 by a conductive feed strap 15 generally of narrow dimension.

In FIG. 2 there is shown a single bay of the present invention comprising a cavity 11, wide slot 12, a coaxial feed line 16. The cavity is a tubular member having a girth in the range $\lambda/2$ to $\lambda$, with a slot in one face of length $\lambda/2$ to $\lambda$ and large width in the range $\lambda/16$ to $3\lambda/16$. ($\lambda$ is a wavelength at a frequency within the band of interest.) Feed strap 24 is an elongated sheet metal member, sometimes tapered near the strip line connection, having a transverse dimension of greater than $\lambda/16$ and preferably less than $\lambda/4$, which connects the slot edge to the center conductor 31 of the feed line through circuitous path.

The feed strap 24 of this antenna is at least $1\frac{1}{2}$ times as long as the direct distance between the edge of the slot and the point of contact with the transmission line feeding the cavity. The strap may even be routed near the inside wall of the cavity on the same side as the edge of the slot to which the strap is connected. This provides greater capacitive coupling between the strap and the walls of the cavity. The coupling is symbolized schematically by the capacitors C in FIG. 3. This capacity, plus the inductance of the long feed strap and the capacity between the slot edge and additional trimmer 42 on the opposite side of the slot forms a resonant circuit.

The feed strap 24 should be connected to about the middle of the slot, a range of $\pm$ $\lambda/8$ from the middle being satisfactory.

On the other hand, in prior art devices such as shown in FIG. 1, the feed strap 15 has been connected by a short, close to direct, path between the center conductor 16 and the edge of the narrow ($<.02\lambda$ wide) slot 13. In the prior art construction the effective point of feed through the cavity is also often directly below the feed strap.

This construction results in a slot and feed of a high characteristic impedance, often in the order of 200 ohms having been found suitable. Since conventional coaxial lines 16 used in broadcasting generally have an impedance of 50 ohms, a $\lambda/4$ long line in the form, e.g., of strip line having an impedance of around 100 ohms so as to also act as a matching transformer can be used, as shown in FIGS. 3 and 4. It has been found that this arrangement further improves the bandwidth of the antenna.

The strip line 18 is a bar spaced from the back wall 19 of the cavity, which wall serves as a ground plane. The bar is approximately $\lambda/4$ long, where $\lambda$ is in the frequency range of interest. This dimension is between the feed point 20 to which the center conductor of the coaxial line is connected, and point 22 to which feed strap 24 is connected.

In order to provide more rigid mechanical support, and obtain additional broadbanding mechanism, the feed line may be extended a distance approximately $\lambda/4$, to a null point, and electrically shorted at the end thereof to the wall of the cavity by a metal spacer block 36. This section is identified by reference numeral 40.

Referring now to FIG. 7, there is shown a slot antenna array 10 consisting of a cavity 11 having a plurality of slots 12 about $\lambda$ apart (between slot centers along the cavity axis) in face 14. The antenna is fed from a transmitter by a two-conductor line such as a coaxial line 16. The feed line 16 may be connected to a strip line feed 43 within the cavity to energize the various slot bays, or each slot may be separately fed from a feed line 16, also, line 16 is preferably bent at 90° immediately upon leaving the cavity, running along the cavity rear to the array end, both to reduce feed line effect on patterns and because such arrays are usually vertical and, therefore, fed from one end.

FIGS. 2–6 show individually fed bays which may be arrayed and fed by a conventional corporate feed system. On the other hand, a single strip line 43 feeding a plurality of bays 12 spaced about λ apart between slot centers along the cavity axis in face 14 shown in FIG. 7. The unitary strip line 43 is energized from a single two-wire conductor 16. It will be noted that the slot of the single unitary cavity 11 is subdivided by shorting bars 17 across the slot to form a linear series of bays forming an array, each bay fed by a strap 24 of the design described above relative to FIG. 2.

In summary, the main feature of the disclosure is a broadband slot antenna which utilizes a wide slot and wide, long feed strap between the feed point and the slot edge, which feed strap, contrary to conventional practice, does not follow a short path between feed point and slot edge but rather is at least one and a half times the direct path length and may run close to the cavity wall and thereby become capacitively coupled thereto.

The antenna may be composed of an array of such slots which may be fed independently or from a common feed line.

As is well recognized in the art, an antenna will act reciprocally for transmission and reception. Accordingly, while described as a transmitting antenna, the apparatus of this invention may be employed as a receiving antenna.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the invention, therefore, to be limited only as indicated by the scope of the claims appended hereto.

What is claimed is

1. A broadband omnidirectional slot antenna consisting of an electrically conductive tube at least λ long, extending along a major axis, having a girth in the range λ/2 to λ and a slot of a length approximately λ/2 to λ and a width in the range λ/16 to 3 λ/16 extending through the tube wall parallel to the major axis; a two conductor transmission line for coupling energy from a signal source to the said slot antenna, one of said conductors connected to the inner wall of the said tube opposite the said slot; a conductive strap having one end thereof connected to one edge of the slot with λ/8 of the middle of the slot along the tube axis and the other end thereof connected to the other of said conductors, said strap having a dimension along the major axis, for most of the length of the strap, in the range greater than λ/16, and less than λ/4, and of length at least 1½times the direct distance between the said connection point to the transmission line and the said slot edge.

2. The antenna of claim 1 wherein said strap for part of its length is positioned proximate the wall of the tube contiguous to the edge of the slot to which said strap is connected, whereby the said strap is capacitively coupled to the tube wall.

3. The antenna of claim 1 wherein said two-conductor transmission line comprises the inner skin of said tube and an electrically conductive bar supported above the said inner skin along the axis of said tube.

4. The antenna of claim 3 wherein said bar is of a length λ/4 between the strap connection and the means for connecting said bar and an external coaxial line.

5. The antenna of claim 4 wherein said bar includes a section thereof extending along the axis λ/4 beyond the connection point and electrically shorted to said wall.

6. A plurality of said slot antennas of claim 1 arranged in an array and spaced approximately λ apart between the middle of the slots along a common axis and means for simultaneously electrically energizing said plurality of antennas with a signal of wavelength λ.

7. The array of claim 6 wherein said plurality of antennas are fed by a common bar within the said tube.

* * * * *